US011504758B2

(12) United States Patent
Irie et al.

(10) Patent No.: US 11,504,758 B2
(45) Date of Patent: Nov. 22, 2022

(54) HOT PRESS PROCESSING METHOD AND HOT PRESS PROCESSING APPARATUS

(71) Applicant: MAZDA MOTOR CORPORATION, Hiroshima (JP)

(72) Inventors: Naoyuki Irie, Hiroshima (JP); Ichirou Ino, Hiroshima (JP); Yoshihide Hirao, Hiroshima (JP); Chie Okawa, Hiroshima (JP)

(73) Assignee: MAZDA MOTOR CORPORATION, Hiroshima (JP)

( * ) Notice: Subject to any disclaimer, the term of this patent is extended or adjusted under 35 U.S.C. 154(b) by 0 days.

(21) Appl. No.: 17/041,307

(22) PCT Filed: Feb. 14, 2019

(86) PCT No.: PCT/JP2019/005309

§ 371 (c)(1),
(2) Date: Sep. 24, 2020

(87) PCT Pub. No.: WO2019/187743

PCT Pub. Date: Oct. 3, 2019

(65) Prior Publication Data

US 2021/0078063 A1 Mar. 18, 2021

(30) Foreign Application Priority Data

Mar. 30, 2018 (JP) ..... JP2018-066820

(51) Int. Cl.
*B21D 22/02* (2006.01)
*C21D 1/673* (2006.01)

(52) U.S. Cl.
CPC ..... *B21D 22/022* (2013.01); *C21D 1/673* (2013.01)

(58) Field of Classification Search
CPC .... B21D 22/022; B21D 22/208; B21D 53/88; C21D 1/673
See application file for complete search history.

(56) References Cited

U.S. PATENT DOCUMENTS 9,227,238 B2 * 1/2016 Ishii ..... B21D 22/286
9,687,898 B2 * 6/2017 Loesch ..... B21D 37/16
(Continued)

FOREIGN PATENT DOCUMENTS

JP 2007-075834 A 3/2007
JP 2007075834 A * 3/2007 ..... C21D 1/673
WO 2012/161192 A1 11/2012

OTHER PUBLICATIONS

Machine Translation for JP-2007075834-A (Year: 2007).*
International Search Report issued in PCT/JP2019/005309; dated Apr. 23, 2019.

*Primary Examiner* — David P Bryant
*Assistant Examiner* — Christine Bersabal
(74) *Attorney, Agent, or Firm* — Studebaker & Brackett PC

(57) ABSTRACT

A hot press processing apparatus 1 includes: a heating step of heating a workpiece W; a pressing step of press-molding, by an upper die 11 and a lower die 12, the workpiece W heated in the heating step after loading the workpiece W between the upper die 11 and the lower die 12; and a cooling step of bringing the coolant into contact with a front surface of the workpiece W that is molded and placed in a pressed state by the pressing step, to thereby cool the workpiece W and place the workpiece W in a quenched state. In the hot press processing apparatus 1, the workpiece W molded and placed in the pressed state by the pressing step forms gaps c2 with respect to both of the upper die 11 and the lower die
(Continued)

12 so as to allow deformation at time of the cooling step except for an accuracy-guaranteed section Wr in the workpiece W.

9 Claims, 5 Drawing Sheets

(56) References Cited

U.S. PATENT DOCUMENTS

| | | | | |
|---|---|---|---|---|
| 2014/0069162 | A1 | 3/2014 | Fukuchi et al. | |
| 2017/0136516 | A1* | 5/2017 | Kim | B21D 26/031 |

* cited by examiner

HOT PRESS PROCESSING METHOD AND HOT PRESS PROCESSING APPARATUS

TECHNICAL FIELD

The technology disclosed herein relates to a hot press processing method and a hot press processing apparatus.

BACKGROUND ART

As a hot press processing method of the present type, a method of obtaining a molded article placed in a quenched state by heating and press-molding a workpiece and then cooling the workpiece in molding dies has been commonly known.

As one example of the hot press processing method (hot press molding method) as above, Patent Literature 1 discloses a feature of press-molding a workpiece (metal plate material) disposed between molding dies (an upper die and a lower die) and then quenching the workpiece by a direct-cooling method in which the surface of the workpiece in a pressed state is cooled by being brought into contact with coolant.

CITATION LIST

Patent Literature

Patent Literature 1: International Publication No. WO 2012/161192

SUMMARY OF INVENTION

Technical Problem

When a general hot press processing method is used, the thermal contraction occurs in the workpiece in accordance with the cooling before and after the removal from the dies. Meanwhile, when the quenching as that described in Patent Literature 1 is performed before the removal of the workpiece from the dies, the volume of the workpiece expands due to organization change in accordance with so-called martensitic transformation.

The thermal contraction in accordance with the cooling and the volume expansion in accordance with the transformation uniformly progress when so-called die cooling is used. However, when the direct-cooling method as that described in Patent Literature 1 is employed, the temperature distribution of the workpiece may be uneven. In other words, while the cooling abruptly progresses in sections with which the coolant is brought into direct contact, the cooling progresses relatively gradually in other sections. As a result, sections of which temperature is relatively high and sections of which temperature is low are mixed in the workpiece.

Due to the unevenness as above, the thermal contraction and the volume expansion progress at different speeds in each portion of the workpiece and diminish each other. As a result, when the workpiece is released from the molding dies, there is a fear that the workpiece may be deformed due to the residual stress thereof. The deformation as above unintentionally occurs and is desired to be suppressed as much as possible in order to enhance the processing accuracy of the molded article.

The technology disclosed herein has been made in view of the abovementioned points, and an object thereof is to enhance the processing accuracy of a molded article when quenching is performed by a direct-cooling method.

Solution to Problem

As a result of intensive studies, the inventors of the present application have focused on intentionally releasing the residual stress in, out of the sections in which the accuracy of the molded article is to be guaranteed and other sections, the latter sections and have found the present disclosure.

Specifically, the technology disclosed herein is according to a hot press processing method for processing a workpiece into a molded article. The hot press processing method includes: a heating step of heating the workpiece; a pressing step of press-molding, by molding dies, the workpiece heated in the heating step after loading the workpiece between the molding dies; and a cooling step of bringing coolant into contact with a front surface of the workpiece that is molded and placed in a pressed state by the pressing step, to thereby cool the workpiece and place the workpiece in a quenched state. In the hot press processing method, the workpiece molded and placed in the pressed state by the pressing step forms gaps with respect to the molding dies so as to allow deformation at time of the cooling step except for a predetermined section in the workpiece.

According to this method, the workpiece is cooled and placed in a quenched state in a state in which the gaps are formed with respect to the molding dies except for the predetermined section serving as the section in which accuracy is to be guaranteed. As a result, deformation is allowed in the section in which the gaps are formed with respect to the molding dies, and hence deformation due to the residual stress may occur in the section in which the gaps are formed.

The deformation due to the residual stress is suppressed in the abovementioned predetermined section when the workpiece is released from the molding dies by the amount by which the residual stress is released in the section in which the gaps are formed. As described above, the section (predetermined section) in which accuracy is to be guaranteed and the section in which deformation caused by the residual stress is allowed are used separately, and the residual stress is intentionally released in the latter section. As a result, unintentional deformation can be suppressed in the former section, and the processing accuracy of the molded article can be enhanced.

The predetermined section may form a section in contact with another member different from the molded article.

In general, a high processing accuracy is required in sections in contact with different members such as a section on which another member is mounted and a section joined to another member as compared to other sections. The abovementioned method can meet such needs.

The predetermined section may be provided in a plurality of places in the workpiece, and the gaps may be provided between the predetermined sections.

A dimension of each of the gaps in a direction along the workpiece may be set to 10 mm or more.

As a result of intensive studies, the inventors of the present application have found that the deformation in the section in which the residual stress is to be released is effectively realized when the dimension of each of the gaps is set to 10 mm or more.

In other words, when the dimension of the gap is set to less than 10 mm, the sections in which accuracy is to be guaranteed come close to each other. As a result, the workpiece is restricted by those sections, and the deformation for releasing the residual stress becomes insufficient.

Meanwhile, when the dimension of the gap is set to 10 mm or more, the sections in which accuracy is to be guaranteed are sufficiently spaced apart from each other, and hence the deformation for releasing the residual stress is sufficiently allowed without restricting the workpiece by those sections.

The molded article may be a vehicle component of an automobile.

The molded article may be a framework component of the automobile.

The molded article may be a pillar member of the automobile.

Another technology disclosed herein is according to a hot press processing apparatus for processing a workpiece into a molded article. The hot press processing apparatus executes: a heating step of heating the workpiece; a pressing step of press-molding, by molding dies, the workpiece heated in the heating step after loading the workpiece between the molding dies; and a cooling step of bringing coolant into contact with a front surface of the workpiece that is molded and placed in a pressed state by the pressing step, to thereby cool the workpiece and place the workpiece in a quenched state. In the hot press processing apparatus, the workpiece molded and placed in the pressed state by the pressing step forms gaps with respect to the molding dies so as to allow deformation at time of the cooling step except for a predetermined section in the workpiece.

According to this configuration, the workpiece is cooled and placed in a quenched state in a state in which the gaps are formed with respect to the molding dies expect for the predetermined section serving as the section in which accuracy is to be guaranteed. As a result, the deformation is allowed in the section in which the gaps are formed with respect to the molding dies, and hence deformation due to the residual stress occurs in the section in which the gaps are formed.

The deformation due to the residual stress is suppressed in the abovementioned predetermined section when the workpiece is released from the molding dies by the amount by which the residual stress is released in the section in which deformation is allowed. As described above, the section in which accuracy is to be guaranteed and the section in which is not to be guaranteed are used separately, and the residual stress is intentionally released in the latter section. As a result, unintentional deformation can be suppressed in the former section, and the processing accuracy of the molded article can be enhanced.

Advantageous Effect of Invention

As described above, the technology disclosed herein is capable of enhancing the processing accuracy of the molded article when the quenching is performed by the direct-cooling method.

DESCRIPTION OF EMBODIMENT

Embodiments of the present invention are described with reference to the drawings. The description below is an example.

Figure 1:
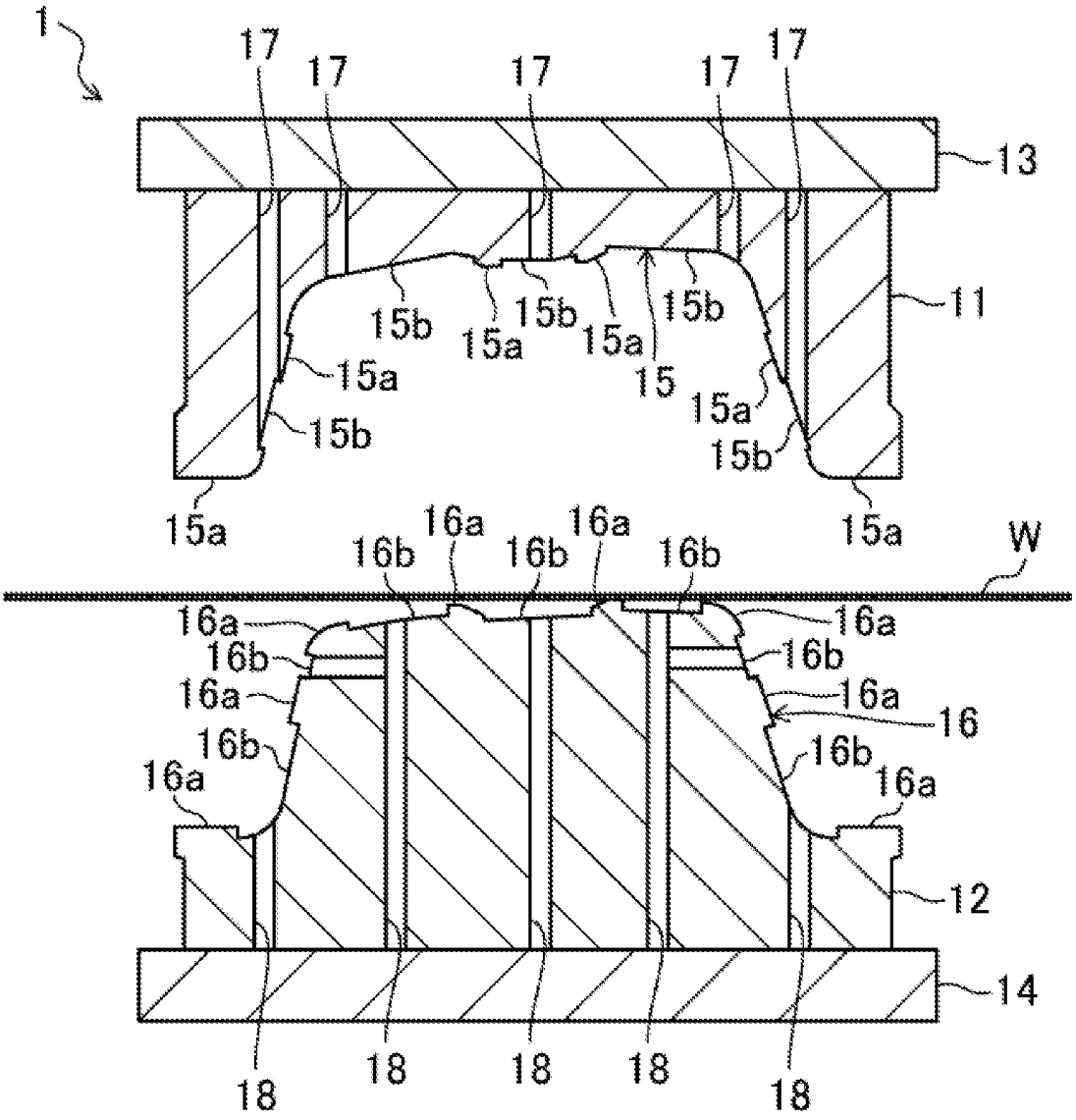
FIG. 1 is a cross-sectional view illustrating a state in which a workpiece is loaded on a hot press processing apparatus.
Figure 2:
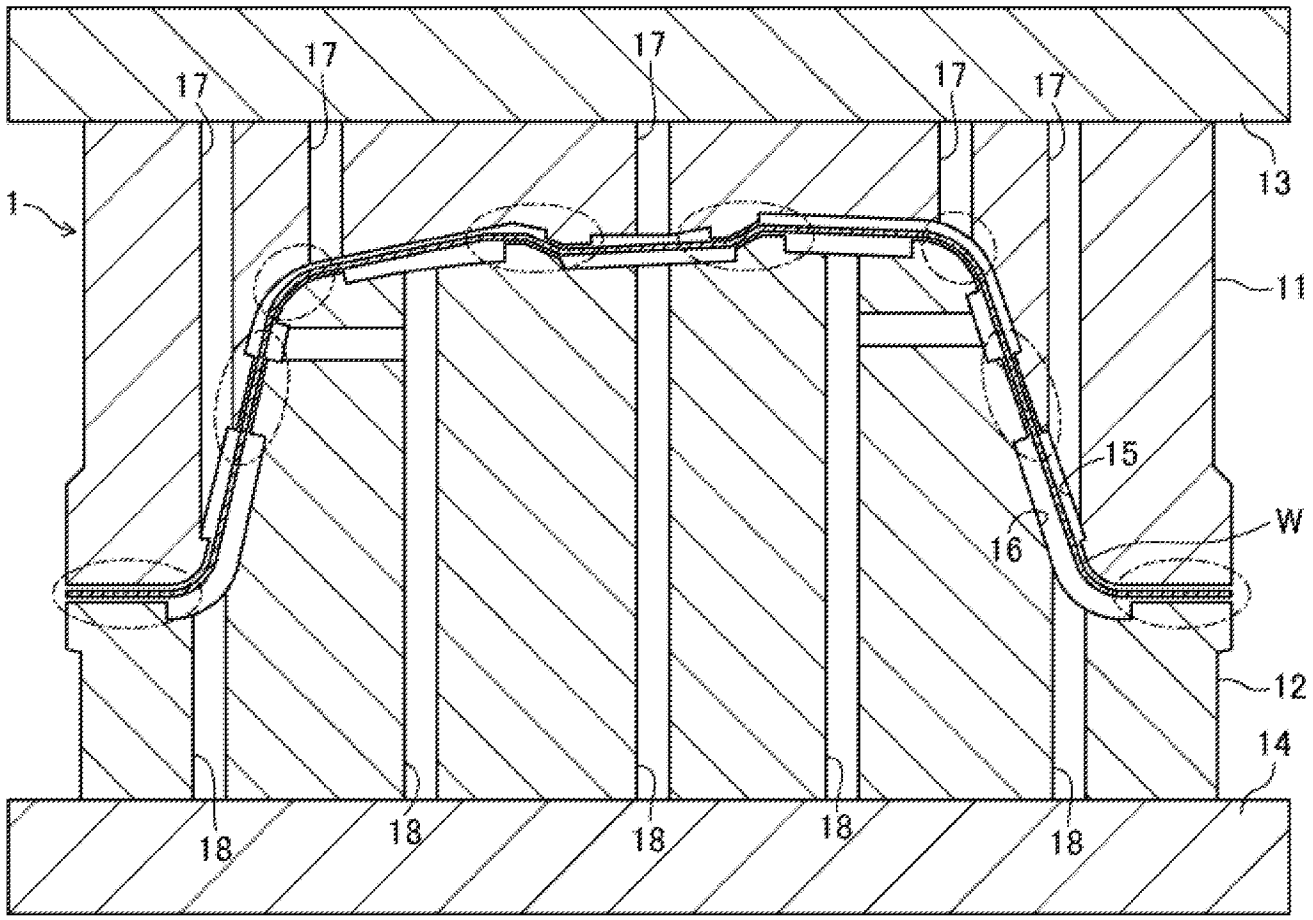
FIG. 2 is a cross-sectional view illustrating a pressed state obtained by the hot press processing apparatus.
Figure 3:
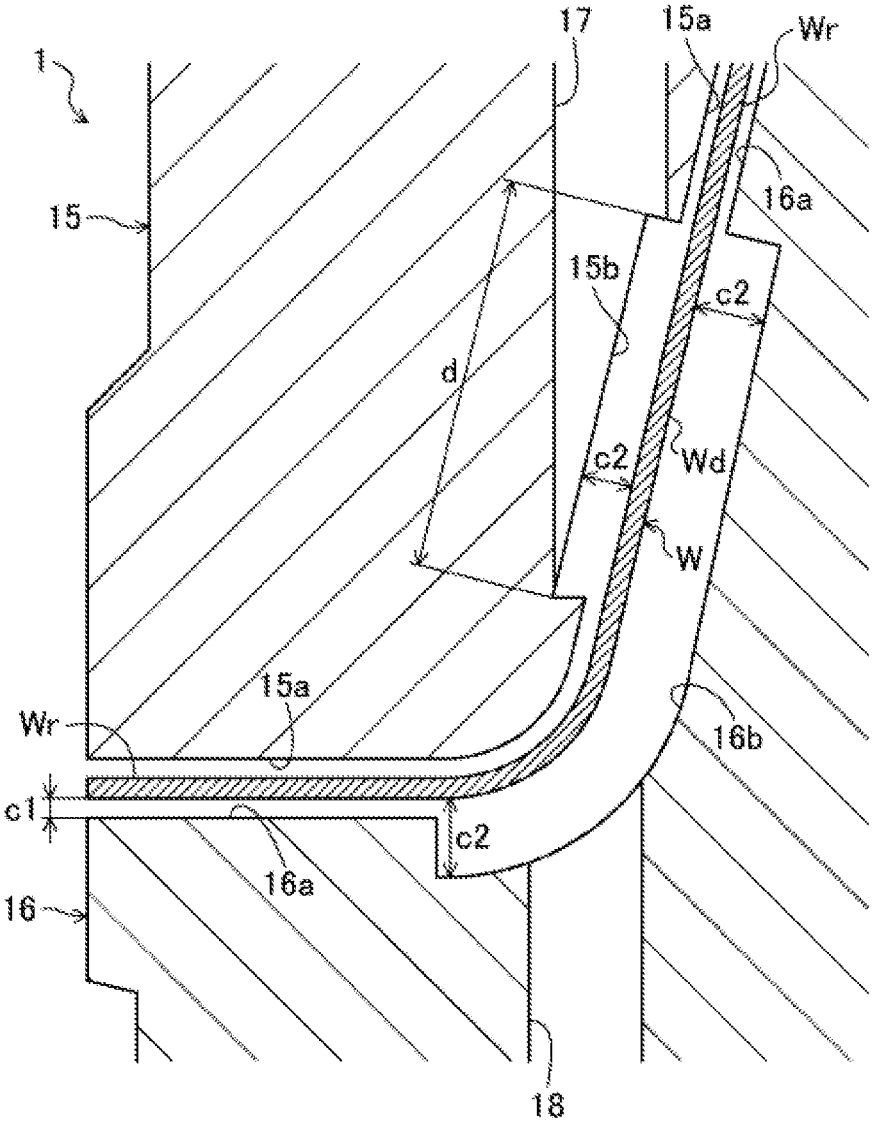
FIG. 3 illustrates FIG. 2 in a partly enlarged manner.
Figure 4:
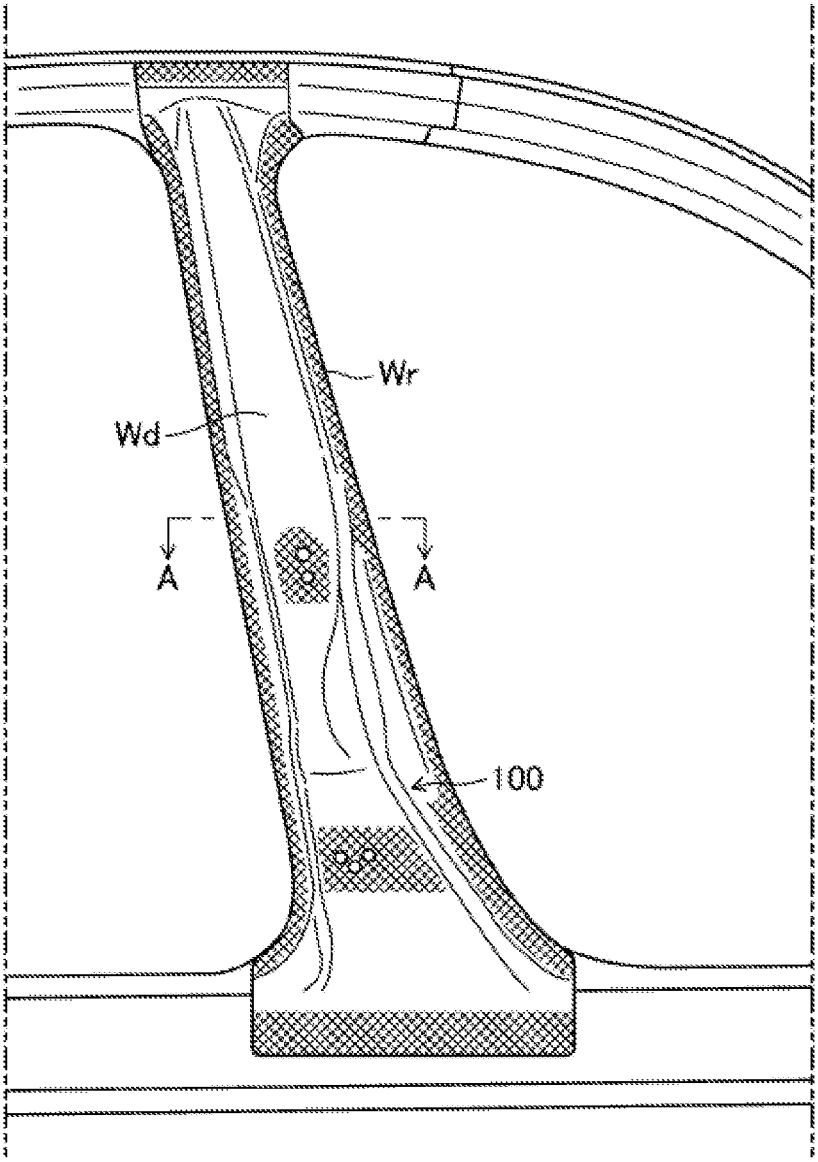
FIG. 4 exemplifies a pillar member serving as a press-molded article.

FIG. 1 to FIG. 3 illustrate a hot press processing apparatus 1 according to this embodiment. The hot press processing apparatus 1 performs press molding of a heated workpiece W, to thereby process the workpiece W into a press-molded article illustrated in FIG. 4.

The press-molded article according to this embodiment is a pillar member 100 that serves as a vehicle component of an automobile. The cross-sectional shape of the pillar member 100 is a hat-shaped profile. Specifically, the pillar member 100 is a center pillar installed between a floor panel and a roof panel of the automobile. In other words, the pillar member 100 is formed to have a long plate shape with a narrow width and is mounted in a posture in which the longitudinal direction is along the vehicle up-down direction when the vehicle is assembled.

In the pillar member 100, a section in which a relatively high processing accuracy is desired, in other words, a section (predetermined section) in which accuracy is to be guaranteed exists. The section is hereinafter referred to as an "accuracy-guaranteed section" and is denoted by reference character "Wr". As illustrated in hatching portions in FIG. 4, the accuracy-guaranteed section Wr is provided in a plurality of places and includes sections corresponding to ridges of the hat-shaped profile of the pillar member 100 and sections in contact with other members. The "sections in contact with other members" herein means, for example, sections on which other members are mounted such as a central portion of the pillar member 100 in the longitudinal direction and sections joined to other members such as a peripheral portion of the pillar member 100.

Hot Press Processing Apparatus

As illustrated in FIG. 1 and FIG. 2, the hot press processing apparatus 1 includes dies (molding dies), in other words, an upper die 11 and a lower die 12 for press molding for obtaining the pillar member 100 serving as the press-molded article. The upper die 11 is fixed to an upper die holder 13. On the upper die holder 13, a slider (not shown) moved up and down by a press machine is mounted. The lower die 12 is fixed to a lower die holder 14.

The lower die 12 includes a protruding molding surface 16 protruding upward. The upper die 11 includes a recessed molding surface 15 corresponding to the protruding molding surface 16 of the lower die 12. Cross sections illustrated in FIG. 1 to FIG. 3 substantially match with a cross section taken along line A-A in FIG. 4 and correspond to the hat-shaped profile of the pillar member 100.

As described above, the plurality of accuracy-guaranteed sections Wr are provided in the pillar member 100. Thus, the recessed molding surface 15 includes first molding surfaces **15*a* for molding the accuracy-guaranteed sections Wr, and second molding surfaces 15*b*** for molding sections other than those sections (hereinafter referred to as "deformation-allowed sections" and denoted by reference character "Wd").

Similarly, the protruding molding surface 16 includes first molding surfaces **16*a* for molding the accuracy-guaranteed sections Wr, and second molding surfaces 16*b* for molding the deformation-allowed sections Wd. The first molding surfaces 16***a* and the second molding surfaces 16*b* of the protruding molding surface 16 are provided in places corresponding to the first molding surfaces 15*a* and the second molding surfaces 15*b* of the recessed molding surface 15.

The configuration of the first molding surfaces 16*a* and the second molding surfaces 16*b* in the protruding molding surface 16 is described below, but the description below is common to the first molding surfaces 15*a* and the second molding surfaces 15*b* in the recessed molding surface 15.

The first molding surfaces 16*a* and the second molding surfaces 16*b* are provided across a plurality of places. As illustrated in FIG. 1 and FIG. 2, the second molding surface 16*b* is provided between the first molding surfaces 16*a*.

As illustrated in FIG. 3 in an exaggerated manner, when the workpiece W is press-molded, a clearance (hereinafter referred to as a "first clearance") c1 between the workpiece W in the pressed state and the first molding surface 16*a* becomes substantially zero (about the amount of tolerance). Meanwhile, when the workpiece W is press-molded, a clearance (hereinafter referred to as a "second clearance") c2 between the workpiece W in the pressed state and the second molding surface 16*b* is set so as to be larger than the first clearance c1. In detail, the second clearance c2 is set within a range of from 0.1 mm to 1.0 mm, and is preferably set within a range of from 0.1 mm to 0.5 mm. The second clearance c2 forms a "gap" described below.

The total area of the second molding surfaces 16*b* provided across a plurality of places is set to be from 50% to 80% of the area of the entire protruding molding surface 16. A dimension (substantially the interval between the first molding surfaces 15*a* as illustrated in FIG. 3) d of each of the second molding surfaces 16*b* in the direction along a front surface of the workpiece W is set to 10 mm or more.

In the upper die 11 and the lower die 12, coolant passages 17 and 18 from which liquid coolant (cold water in this embodiment) is supplied for cooling the workpiece W in the pressed state are provided. The hot press processing apparatus 1 according to this embodiment employs a direct-cooling method in which cold water is sprayed on the workpiece W in the pressed state. In order to carry out the direct-cooling method, the coolant passages 17 are opened in the recessed molding surface 15 and are preferably opened in the second molding surfaces 15*b* of the recessed molding surface 15. Similarly, the coolant passages 18 are opened in the protruding molding surface 16 and preferably opened in the second molding surface 16*b* of the protruding molding surface 16.

As illustrated in FIG. 1, the workpiece W is formed by a blank material on a flat plate. The workpiece W is heated to a predetermined temperature (austenite temperature range) in advance and is loaded between the upper die 11 and the lower die 12.

The workpiece W is molded by hot stamping in which the workpiece W is press-molded and is then cooled in the pressed state. In other words, the protruding molding surface 16 and the recessed molding surface 15 plastically deform the workpiece W when descending toward the upper die 11 and the lower die 12, to thereby form the cross-sectional shape having a hat-shaped profile.

When the workpiece W is in the pressed state, the first molding surfaces 15*a* and 16*a* for molding the accuracy-guaranteed sections Wr approach or come into contact with the workpiece W (see the circled portions in FIG. 2) in accordance with the value of the first clearance c1. Meanwhile, when the workpiece W is in the pressed state, the second molding surfaces 15*b* and 16*b* for molding the deformation-allowed sections Wd form the gaps with respect to the workpiece W in accordance with the value of the second clearance c2. The "gap" is hereinafter also denoted by reference character "c2". In the direction along the front surface of the workpiece W, the gaps c2 and the deformation-allowed section Wd are provided between the accuracy-guaranteed sections Wr.

A hot press processing method using the hot press processing apparatus 1 is described in detail below.

Hot Press Processing Method

Figure 5:
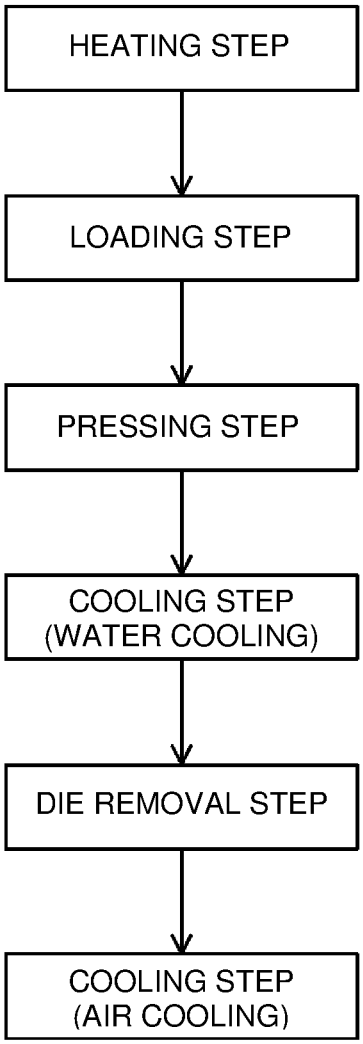
FIG. 5 exemplifies a procedure of a hot press processing method.

FIG. 5 exemplifies a procedure of the hot press processing method.

1. Heating Step

First, the flat-plate-shaped workpiece W is heated and is heated to the Ac3 point or more. As a result, the transformation of the workpiece W to austenite is completed.

2. Loading Step

As illustrated in FIG. 1, the heated workpiece W is loaded between the upper die 11 and the lower die 12.

3. Pressing Step

As illustrated in FIG. 2, the upper die 11 is caused to descend, and the workpiece W is press-molded into a shape following the recessed molding surface 15 of the upper die 11 and the protruding molding surface 16 of the lower die 12. An outer surface of the workpiece W is molded into a hat-shaped profile. At this time, the second molding surfaces 15*b* and 16*b* in the recessed molding surface 15 and the protruding molding surface 16 form the gaps c2 with respect to the workpiece W in the pressed state as described above.

4. Cooling Step (Water Cooling)

In a state in which the workpiece W is molded and is placed in a pressed state by the upper die 11 and the lower die 12, cold water is caused to flow through the coolant passages 17 in the upper die 11 and the coolant passages 18 in the lower die 12. The cold water comes into contact with the front surface of the workpiece W in the pressed state through openings provided in the recessed molding surface 15 and the protruding molding surface 16. The cold water that has come into contact with the front surface of the workpiece W cools the workpiece W to a point that is less than the Ms point. As a result, martensitic transformation of the workpiece W is performed, and the workpiece W is placed in a quenched state.

5. Die Removal Step

Although illustration is omitted, the upper die 11 is caused to ascend, and the press-molded workpiece W is removed from the die. The workpiece W removed from the die is carried out from the lower die 12.

6. Cooling Step (Air Cooling)

The workpiece W carried out from the lower die 12 is air-cooled by the atmosphere. As a result, the quenched workpiece W is cooled in a manner that is more gradual as compared to the water cooling performed by the cold water and reaches a normal temperature.

Deformation Due to Residual Stress

Incidentally, in the workpiece W before and after being removed from the dies, thermal contraction occurs in accordance with the water cooling and the air cooling. Meanwhile, when quenching as described above is performed before the removal of the workpiece W from the dies, the volume of the workpiece W expands due to organization change in accordance with martensitic transformation.

The thermal contraction in accordance with the cooling and the volume expansion in accordance with the transformation uniformly progress when so-called die cooling is used. However, when the direct-cooling method described above is employed, the temperature distribution of the workpiece W may be uneven. In other words, while the cooling abruptly progresses in the sections with which cold water is brought into direct contact such as sections facing the openings of the coolant passages 17 and 18, the cooling progresses relatively gradually in sections other than those sections. As a result, sections of which temperature is relatively high and sections of which temperature is low are mixed in the workpiece W.

Due to the unevenness as above, the thermal contraction and the volume expansion progress at different speeds in each portion of the workpiece W and diminish each other. As a result, when the workpiece W is released from the molding dies, there is a fear that the workpiece W may be deformed due to the residual stress thereof. The deformation as above unintentionally occurs and is desired to be suppressed as much as possible in order to enhance the processing accuracy of the pillar member 100.

Thus, in this embodiment, the workpiece W in the pressed state forms the gaps c2 with respect to both of the upper die 11 and the lower die 12 so as to allow deformation at the time of water cooling except for the accuracy-guaranteed sections Wr in the workpiece.

In other words, as described above, the workpiece W is cooled and placed in a quenched state in a state in which the gaps c2 are formed with respect to the upper die 11 and the lower die 12 except for the accuracy-guaranteed sections Wr serving as sections in which accuracy is to be guaranteed. As a result, deformation is allowed in sections in which the gaps c2 are formed with respect to the upper die 11 and the lower die 12, in other words, in the deformation-allowed sections Wd, and hence deformation due to the residual stress occurs in the deformation-allowed sections Wd.

Then, the deformation due to the residual stress is suppressed in the accuracy-guaranteed sections Wr when the workpiece W is removed from the upper die 11 and the lower die 12 by the amount by which the residual stress is released in the deformation-allowed sections Wd. As described above, the sections (accuracy-guaranteed sections Wr) in which accuracy is to be guaranteed and the sections (deformation-allowed sections Wd) in which deformation caused by the residual stress is allowed are used separately, and the residual stress is intentionally released in the latter sections. As a result, unintentional deformation can be suppressed in the former sections, and the processing accuracy of the pillar member 100 serving as the molded article can be enhanced.

In the deformation-allowed sections Wd, the pressure applied when the workpiece W is press-molded can be reduced by the amount by which the gaps c2 are provided. As a result, when the press molding is performed, the load on the hot press processing apparatus 1 is reduced.

The processing accuracy is not desired in the deformation-allowed sections Wd as much as in the accuracy-guaranteed sections Wr in the first place. By providing sections as above across a plurality of places, the processing of the workpiece W becomes easier.

Sections corresponding to the ridges of the pillar member 100 have a higher rigidity than other sections. Therefore, the deformation in parts corresponding to the ridges affects the processing accuracy of the entire pillar member 100. Therefore, by causing the sections corresponding to the ridges of the pillar member 100 to be the accuracy-guaranteed sections Wr, the processing accuracy of the entire pillar member 100 can be secured.

The dimension of the gap c2 in the direction along the front surface of the workpiece W, in other words, the dimension d of the second molding surfaces 15*b* and 16*b* is set to 10 mm or more as described above.

As a result of intensive studies, the inventors of the present application have found that the deformation in the deformation-allowed section Wd is effectively realized when the dimension d of the second molding surfaces 15*b* and 16*b* is set to 10 mm or more.

In other words, when the dimension d of the second molding surfaces 15*b* and 16*b* is set to less than 10 mm, the accuracy-guaranteed sections Wr in addition to the first molding surfaces 15*a* and 16*a* come relatively close to each other. As a result, the workpiece W is restricted by the accuracy-guaranteed sections Wr, and the deformation in the deformation-allowed sections Wd becomes insufficient.

Meanwhile, when the dimension d of the second molding surfaces 15*b* and 16*b* is set to 10 mm or more, the accuracy-guaranteed sections Wr are sufficiently spaced apart from each other. As a result, the deformation for releasing the residual stress is sufficiently allowed without restricting the workpiece by the accuracy-guaranteed sections Wr.

Another Embodiment

In the abovementioned embodiment, as one example of the molded article, the pillar member has been described as the vehicle component of the automobile, but the technology disclosed herein can also be applied to a framework component of the automobile such as a side frame. Even in this case, unintentional deformation can be suppressed, and the processing accuracy of the molded article can be enhanced.

In the abovementioned embodiment, a configuration in which air cooling is performed by the atmosphere after the die removal step has been described, but the present invention is not limited to this configuration. For example, slow cooling may be performed in the die.

REFERENCE SIGNS LIST

1 Hot press processing apparatus
11 Upper die (molding die)
12 Lower die (molding die)
15 Recessed molding surface
15*a* First molding surface
15*b* Second molding surface
16 Protruding molding surface
16*a* First molding surface
16*b* Second molding surface
17 Coolant passage
18 Coolant passage
100 Pillar member
c2 Gap
W Workpiece Wr Accuracy-guaranteed section (predetermined section)

Wd Deformation-allowed section (section besides predetermined section)

The invention claimed is:

1. A hot press processing method for processing a workpiece into a molded article, the hot press processing method comprising:

a heating step of heating the workpiece;

a pressing step of press-molding, by molding dies, the workpiece heated in the heating step after loading the workpiece between the molding dies; and a cooling step of bringing coolant into contact with a front surface of the workpiece that is molded and placed in a pressed state by the pressing step, to thereby cool the workpiece and place the workpiece in a quenched state, wherein in the pressing step, the workpiece molded and placed in the pressed state forms gaps with respect to the molding dies except for at a predetermined section of the workpiece, in the cooling step, the workpiece is cooled in the pressed state so as to allow deformation of the workpiece during the cooling step except for at the predetermined section of the workpiece, the molding dies include a coolant passage supplying the coolant to the workpiece, the coolant passage communicates with a molding surface serving as one of the gaps, and in the cooling step, the coolant is supplied to the one of the gaps through the coolant passage.

2. The hot press processing method according to claim 1, characterized in that the predetermined section is provided in a plurality of places in the workpiece, and the gaps are provided between the predetermined sections.

3. The hot press processing method according to claim 2, characterized in that a dimension of each of the gaps in a direction along the workpiece is set to 10 mm or more.

4. The hot press processing method according to claim 1, characterized in that the molded article is a vehicle component of an automobile.

5. The hot press processing method according to claim 4, characterized in that the molded article is a framework component of the automobile.

6. The hot press processing method according to claim 4, characterized in that the molded article is a pillar member of the automobile.

7. The hot press processing method according to claim 1, characterized in that the molded article is a vehicle component of an automobile, the molded article is a pillar member of the automobile, the pillar member includes a plurality of accuracy-guaranteed sections in which accuracy is to be guaranteed, the plurality of accuracy-guaranteed sections each serve as the predetermined section of the workpiece, and at least part of the plurality of accuracy-guaranteed sections are sections corresponding to ridges of the pillar member.

8. The hot press processing method according to claim 1, characterized in that the molded article is a vehicle component of an automobile, the molded article is a pillar member of the automobile, the pillar member is provided with a plurality of accuracy-guaranteed sections in which accuracy is to be guaranteed, the plurality of accuracy-guaranteed sections each serve as the predetermined section of the workpiece, and at least part of the plurality of accuracy-guaranteed sections are a central portion of the pillar member in a longitudinal direction and a peripheral portion of the pillar member.

9. The hot press processing method according to claim 1, characterized in that the workpiece molded and placed in the pressed state by the pressing step forms the gaps with respect to both an upper die and a lower die of the molding dies except for at the predetermined section of the workpiece so as to allow deformation of the workpiece during the cooling step, and a gap between the upper die and the workpiece and a gap between the lower die and the workpiece are disposed to at least partially face each other across the workpiece.

* * * * *